US007637274B1

(12) United States Patent
Dodson

(10) Patent No.: US 7,637,274 B1
(45) Date of Patent: Dec. 29, 2009

(54) ARTICULATING GLIDE ASSEMBLY

(76) Inventor: Rodney Dodson, 430 Live Oak La., Boynton Beach, FL (US) 33436

( * ) Notice: Subject to any disclaimer, the term of this patent is extended or adjusted under 35 U.S.C. 154(b) by 0 days.

(21) Appl. No.: 12/114,229

(22) Filed: May 2, 2008

(51) Int. Cl.
*A45B 9/04* (2006.01)

(52) U.S. Cl. ..... 135/84; 135/86

(58) Field of Classification Search ..... 135/65, 135/77, 82, 84, 86; 16/42 T
See application file for complete search history.

(56) References Cited

U.S. PATENT DOCUMENTS 4,440,186 A * 4/1984 Lottner ..... 135/84
4,899,771 A * 2/1990 Wilkinson ..... 135/77
2006/0219280 A1 * 10/2006 Robinson et al. ..... 135/84

* cited by examiner

*Primary Examiner*—David Dunn
*Assistant Examiner*—Danielle Jackson

(57) ABSTRACT

An articulating glide assembly for use on a walker that assists disabled individuals to walk comprises an adapter having a sleeve for engaging a leg of the walker and a base for supporting the downward force exerted by the walker. The base defines a hole for receiving a portion of an articulating foot that is movably engaged with the base. A replaceable glide is affixed to a lower portion of the foot.

8 Claims, 7 Drawing Sheets

ARTICULATING GLIDE ASSEMBLY

BACKGROUND OF THE INVENTION

1. Field of the Invention

The present invention relates to protective feet for tubular legs in general and more particularly to an articulating foot for use on walkers.

2. Discussion of the Related Art

Many elderly individuals and in some instances younger people who have certain disabilities are unable to walk unassisted. They require assistance from either a health care professional or from a mechanical device to provide them with added stability. These mechanical devices range from a simple cane to motorized wheelchairs depending on the severity of the individual's infirmity. One of the most common mechanical aids is a walker. A walker in its simplest form comprises a pair of inverted U-shaped metal tubes that are laterally spaced one from the other and connected at one leg of the U-shape.

In use, the user's hands grasp the upper portion of the U-shaped tubes to provide stability while standing. When the user desires to walk forward, the individual first moves the walker forward and then while using the walker for support, walks forward to stand between the U-shaped tubes at which time the process is repeated until arriving at a desired destination. Each bottom end of the tubes is usually covered with a rubber cap, also known as a foot or glide, to provide stabilized support and to resist slipping on smooth surfaces. The glide also prevents scratching of the floor that would occur from uncovered metal tubes scraping along the surface. This configuration requires the user to lift the entire walker off the floor surface to move. Walkers can be configured in a number of different ways to ease use. Some walkers are equipped with front wheels to assist in moving the walker forward without the need to completely lift the walker off the floor.

For the individuals who lack the strength or endurance to completely lift the walker during a walk, often the resilient glides at the bottom of the tubes are drug along the floor surface causing rapid wear. This wear is frequently combated by placing tennis balls over the bottoms of the legs which also allows the feet of the walker to slide over the floor surface without undue wear on the rubber feet. Even when the user is able to repeatedly lift and place forward the walker, the motion is usually in an arcuate motion such that placement of the walker legs results in only an edge of the rubber foot supporting the leg of the walker. This also causes premature wear of the glide on the walker legs and results in less than optimum stability for the user.

Thus, what is desired is an articulating glide for a walker that adapts to a leg contacting the floor in other than a right angle and prevent undue wear of the foot and to provide maximum traction to prevent undesired slippage of the walker in use.

SUMMARY OF THE INVENTION

The present invention is directed to an articulating glide assembly that satisfies the need for articulation to provide maximum surface contact of the feet of the walker with a floor on which it is being used. The articulating glide assembly comprises an adapter having a sleeve for engaging a leg of the walker and a base for supporting the downward force exerted by the walker. The base defines a hole for receiving a portion of an articulating foot that is movably engaged with the base. A replaceable glide is affixed to a lower portion of the foot.

Another aspect of the present invention is an articulating glide assembly for use on a walker that assists disabled individuals to walk, wherein the glide assembly includes an adapter having a resilient cannular sleeve defining an opening at a top end thereof for engaging a leg of a walker and an aperture at a bottom end. A rigid base insert that defines a central hole therethrough is engaged in the aperture at the bottom end of the sleeve for supporting the downward force exerted by the walker. An articulating foot includes an upwardly extending spherical surface from a top of the foot and a pin extending upwardly from the spherical surface. The spherical surface engages an edge of the hole in the base insert and the pin extends through the hole and is movably engaged therein. A glide is removably affixed to a lower portion of the articulating foot.

These and other features, aspects, and advantages of the invention will be further understood and appreciated by those skilled in the art by reference to the following written specification, claims and appended drawings, which follow.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF REPRESENTATIVE EMBODIMENTS

Figure 1:
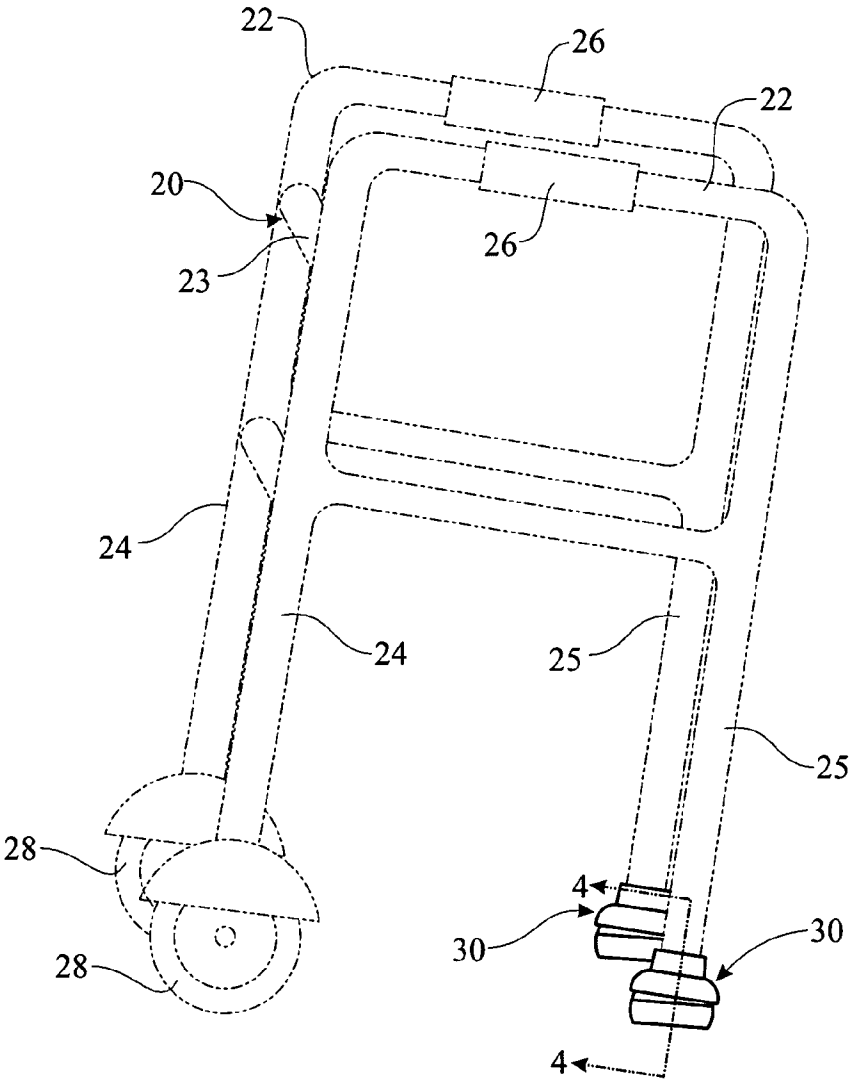
FIG. 1 is a perspective view of a walker, wherein the legs of the walker are equipped with articulating glide assemblies embodying the present invention.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
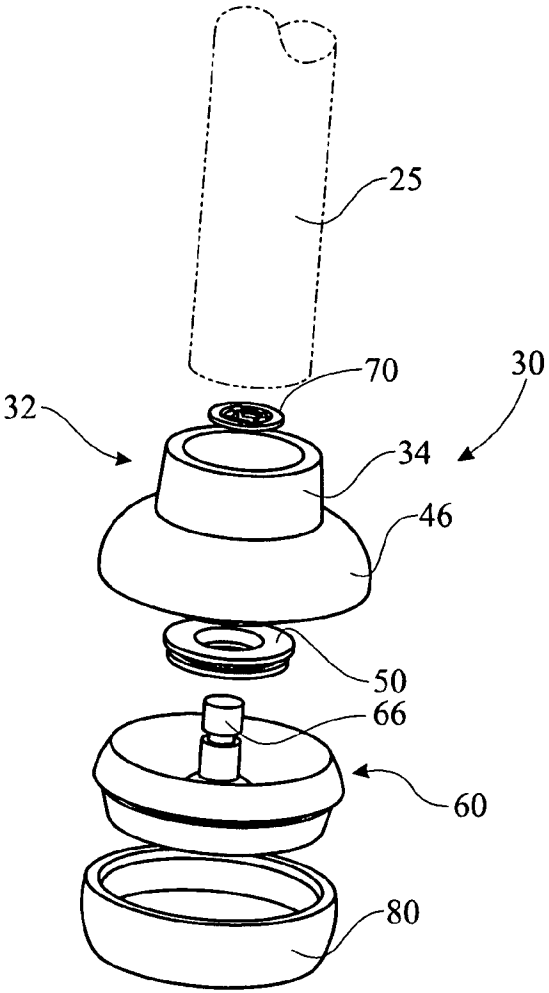
FIG. 3 is an exploded perspective view of the glide assembly shown in FIG. 1.
Figure 2:
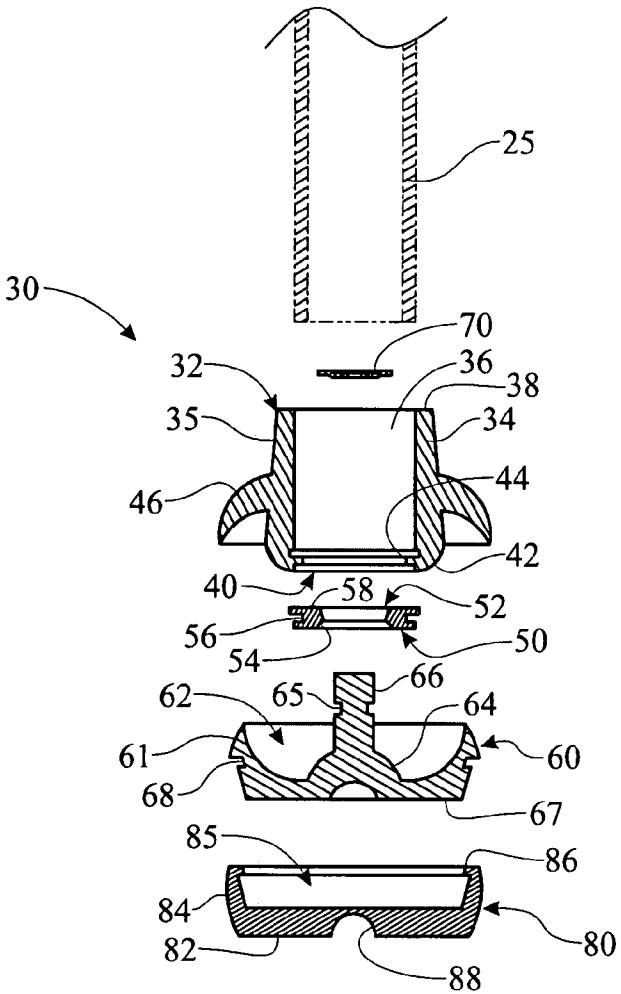
FIG. 2 is an exploded elevation cross-sectional view of the glide assembly shown in FIG. 1.
Figure 4:
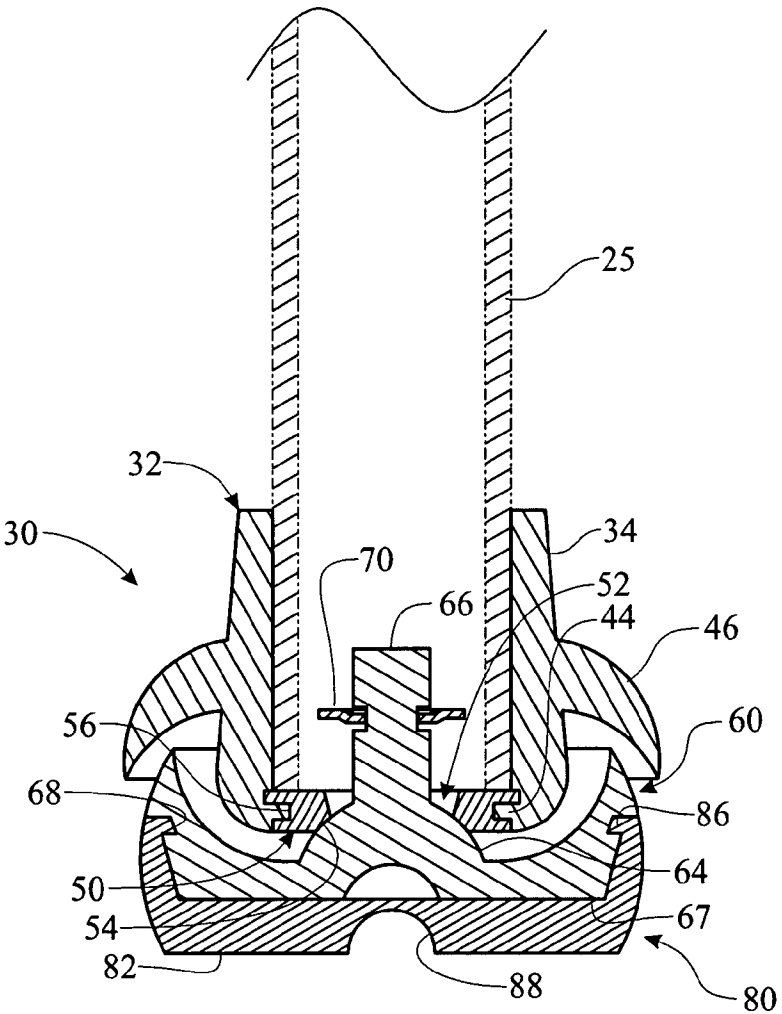
FIG. 4 is an elevation cross-section of the glide assembly shown in FIG. 1, take along the line 4-4.

Turning to the drawings, FIG. 1 shows a walker 20 that is useful for stabilizing and assisting frail individuals to walk. Walker 20 generally comprises a pair of inverted U-shaped frames 22 laterally spaced one from the other by bars 23 at a front of walker 20 to form an open structure that can partially encompass the user. Handles 26 are at an upper end of frames 22 for grasping by the user. Frames 22 terminate at a lower portion thereof in front legs 24 and rear legs 25 which are generally tubular in configuration. Each bottom of front legs 24 has a wheel assembly 28 mounted thereto and each rear leg 25 has attached thereto an articulating glide assembly 30 which is one of the preferred embodiments of the present invention. Other configurations of walker 20 can have a glide assembly 30 attached to the bottoms of legs 24 in lieu of wheel assemblies 28. FIGS. 2-4 illustrate the various components of articulating glide assembly 30.

Referring now to FIGS. 2-4, a preferred embodiment of articulating glide assembly 30 includes an adapter 32, a rigid base insert 50, an articulating foot 60, and a glide 80. Adapter 32 has a resilient cannular sleeve 34 typically molded from a natural or synthetic rubber. Sleeve 34 defines an opening 36 at a top end 38 of sleeve 32. Opening 36 is sized to closely receive tubular leg 25 of walker 20. Those practiced in the art will recognize that adapter 32 can assume multiple configurations to accommodate the many cross-sectional variations in legs 25 of different models of walkers 20. Cannular sleeve 34 also defines an aperture 40 at a bottom 42 of sleeve 34. A lip 44 extends radially inward from sleeve 34 at aperture 40. A rigid base insert 50 is formed from a rigid polymer such as nylon and is of sufficient strength to bear the downward force generated at leg 25 during use. Insert 50 is received in aperture 40 and is retained therein by lip 44 engaging a peripheral groove 56 formed about the exterior periphery of insert 50. Insert 50 also defines a central hole 52 through body 58 of insert 50. Hole 52 is further defined by a spherical chamfer 54 at a lower edge thereof and a top portion of hole 52 can be tapered such that the diameter of hole 52 is wider at the top of body 58 and narrower at a mid-thickness portion of body 58.

Articulating foot 60 is formed of a rigidly molded body 61. Body 61 can also be molded from nylon or a similar polymer. As shown in FIG. 2, body 61 defines a horizontally oriented peripheral groove 68 extending around an exterior surface thereof and defines a concave recess 62 in a top portion of foot 60. A spherical surface 64 extends upwardly from the bottom of concave recess 62 and when in contact with base insert 50 is articulately seated in spherical chamfer 54. A pin 66 extends upwardly from spherical surface 64 and extends through hole 52 of insert 50. Pin 66 defines a circumferential recess 65 proximate to a top portion thereof and is secured in hole 52 of insert 50 in movable relationship therewith by retainer 70 engaged in recess 65. Hole 52 is significantly larger than the diameter of pin 66 to allow lateral movement of pin 66 therein and spherical surface 64 to pivot within spherical chamfer 54 of base insert 50. Retainer 70 is of sufficient diameter to prevent pin 66 from slipping through hole 52 when walker 20 is lifted off of the surface on which it rests.

While the preferred embodiment as shown in the figures illustrate body 61 as defining a concave recess 62, body 61 can be any configuration that includes sufficient clearance for spherical surface 64 and pin 66 to pivot within base insert 50.

A skirt 46 extends peripherally from an outer surface 35 of cannular sleeve 34. Skirt 46 is sized and shaped to cover foot 60 in an umbrella-like fashion while allowing foot 60 to pivot with respect to adapter 32 as previously described. Skirt 46 shields foot 60 from debris and provides an aesthetic appearance to glide assembly 30.

A glide 80 includes a resilient tread layer 82 at a bottom thereof and has an upwardly extending peripheral wall 84 that defines a recess 85 sized to receive therein a bottom portion 67 of articulating foot 60. Wall 84 includes an inwardly oriented lip 86 at a top thereof. Lip 86 engages groove 68 of foot 60 to securely retain glide 80 on foot 60. A wear indicator 88 is positioned on a bottom of resilient tread layer 82. In the preferred embodiment, wear indicator 88 comprises a concave recess extending upwardly from the bottom surface of glide 80. As tread layer 82 of glide 80 wears, the concave recess of indicator 88 becomes more and more shallow. When the concave recess has disappeared or is near to disappearing, the glide needs to be replaced. To replace glide 80, lip 86 is disengaged from groove 68 of foot 60 and discarded and a new glide 80 is then installed.

Figure 8:
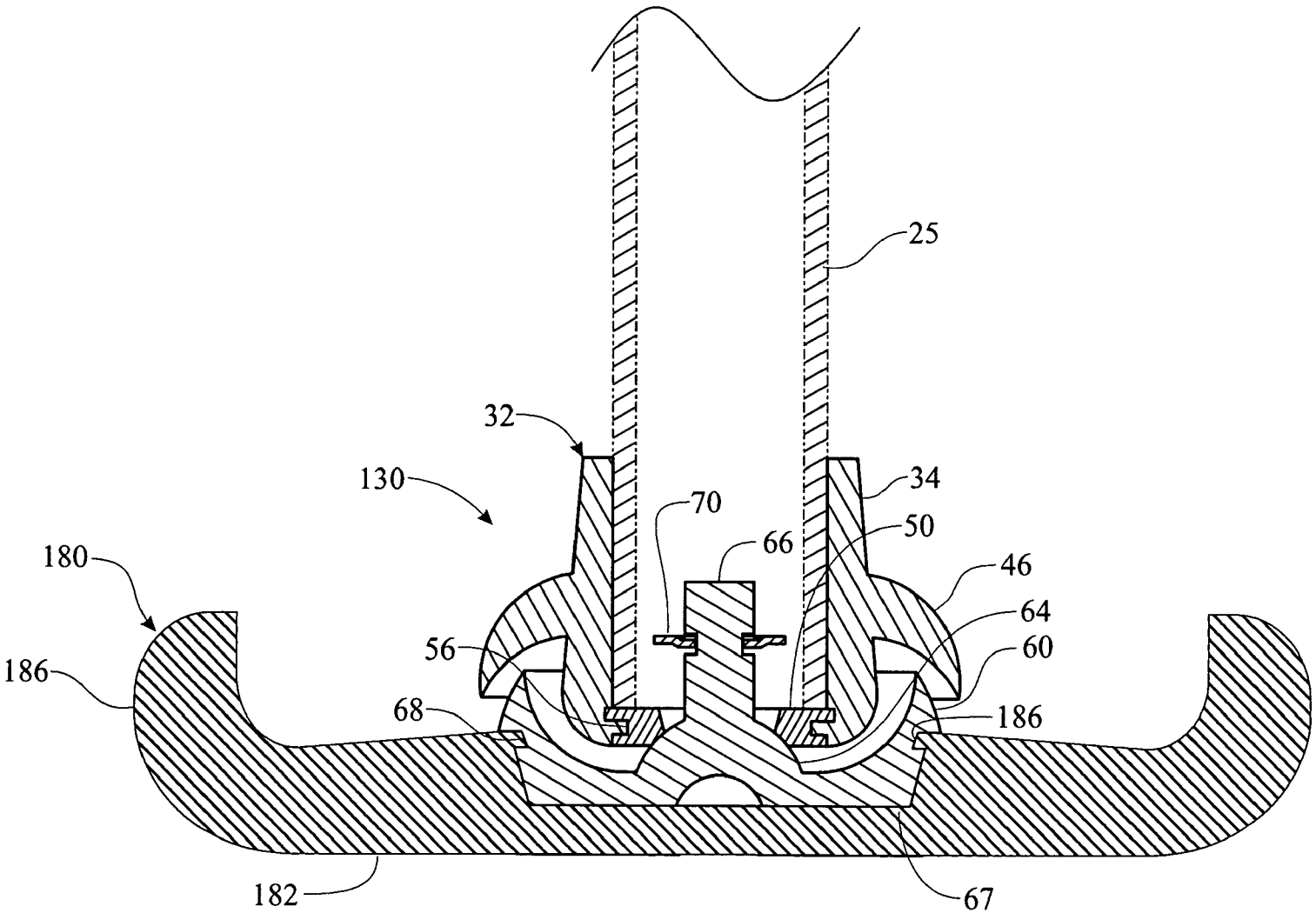
FIG. 8 is an elevation cross-section of an alternate embodiment glide assembly wherein an oversize glide is affixed to the foot.

Referring to FIG. 8, an alternate embodiment articulating glide assembly 130 is illustrated. Glide assembly 130 includes the same adapter 32, rigid insert 50, and foot 60 as illustrated with assembly 20, however a different glide 180 is installed on foot 60. Glide 180 has a tread layer 182 that is much larger in area, preferably at least twice as large, than the area of bottom portion 67 of foot 60 and also includes an upturned periphery 186. Glide 180 is affixed to foot 60 in the same manner as foot 80 wherein bottom portion 67 is inserted into glide 180 such that inwardly oriented lip 186 engages groove 68 of foot 60. The large area of tread layer 182 is advantageous when walker 20 is desired to be used on soft surfaces where the large area of tread 182 will prevent sinking into the supporting layer such as sand or loose soil.

Figure 10:
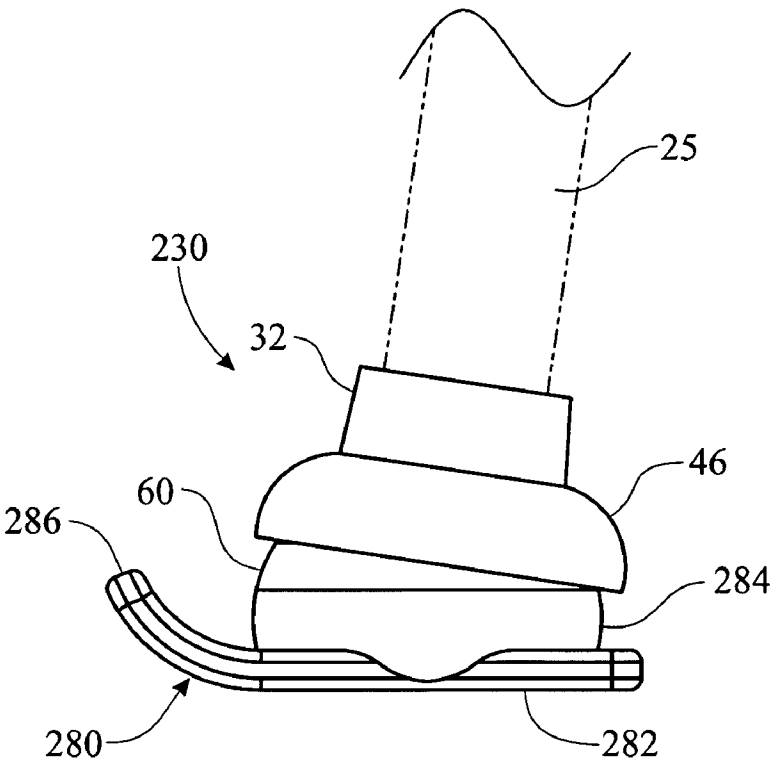
FIG. 10 is a side elevation view of the alternate embodiment glide assembly of FIG. 9 including ski-shaped glide affixed to the foot.
Figure 9:
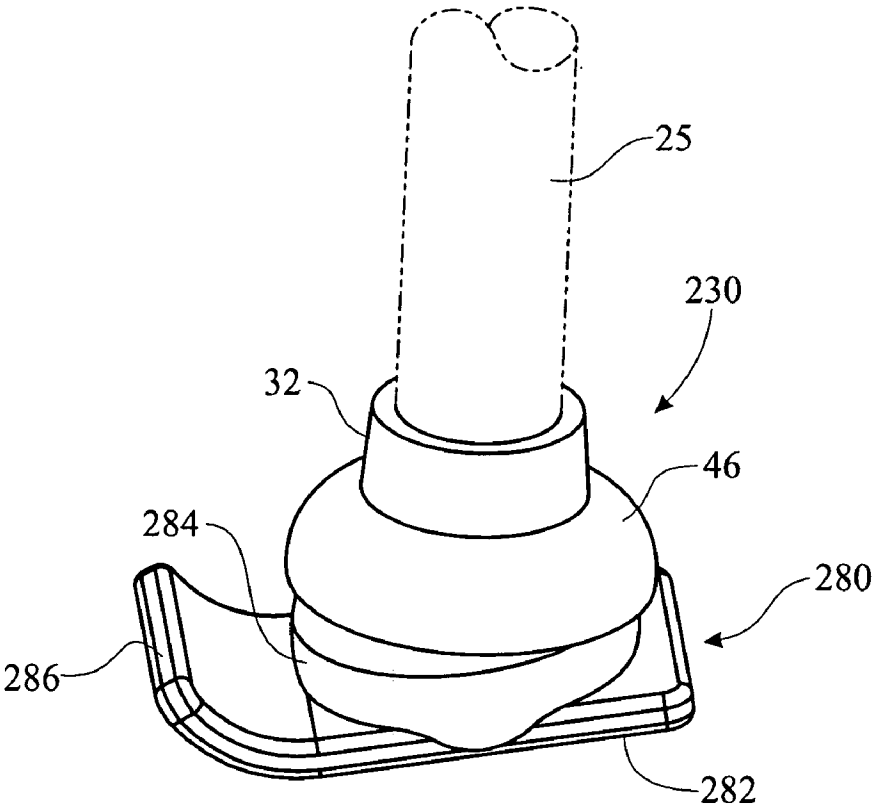
FIG. 9 is a perspective view of an alternate embodiment glide assembly including a ski-shaped glide affixed to the foot.

As shown in FIGS. 9-10, another embodiment of glide assembly is shown. Glide assembly 230 again includes the same adapter 32, rigid insert 50, and foot 60 as illustrated with assembly 20, with yet again a different glide 280 installed on foot 60. Glide 280 includes an elongate rectilinear tread layer 282 that includes one upturned end 286 thereof. Tread layer 282 has an upwardly extending wall 284 for encompassing and receiving bottom portion 67 of foot 60 and is retained on foot 60 with a lip (not shown) engaging groove 68 in a manner identical to that shown in FIG. 4 with glide 80. Glide 280 is useful over uneven terrain when the walker is slid along the terrain surface rather than picked up and set down. Upturned end 286 guides tread layer 282 over the uneven rises without experiencing an edge of a glide, such as small glide 80, catching the turf and inducing a tipping force possibly causing the user to fall.

Figure 5:
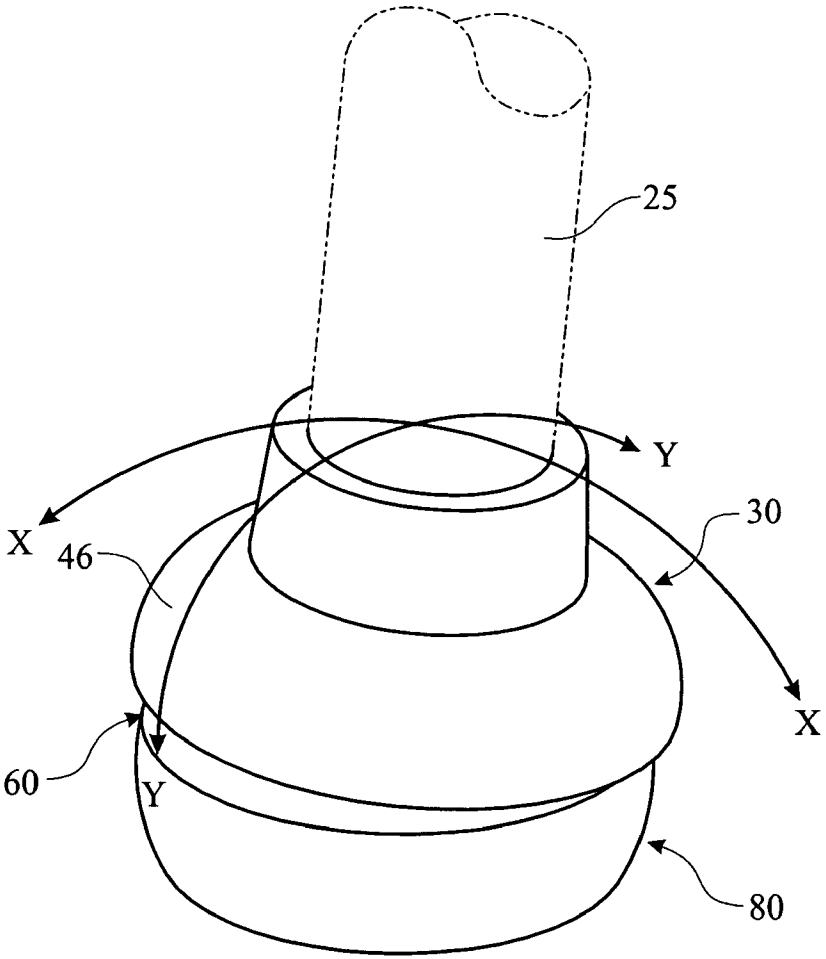
FIG. 5 is a perspective view of the articulating glide assembly on the leg of a walker illustrating the angular articulation of the glide assembly.
Figure 7:
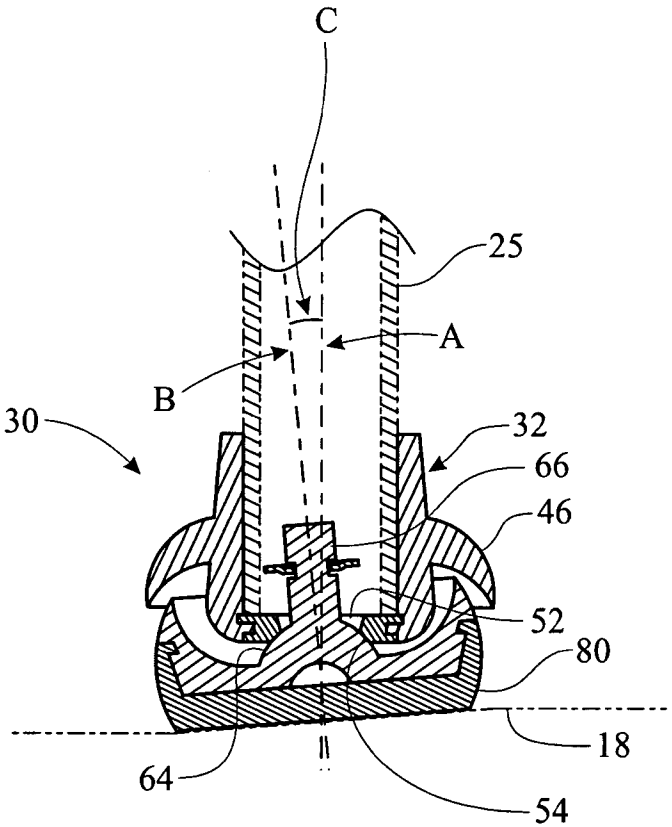
FIG. 7 is a cross-sectional view of the articulated glide assembly of FIG. 6.
Figure 6:
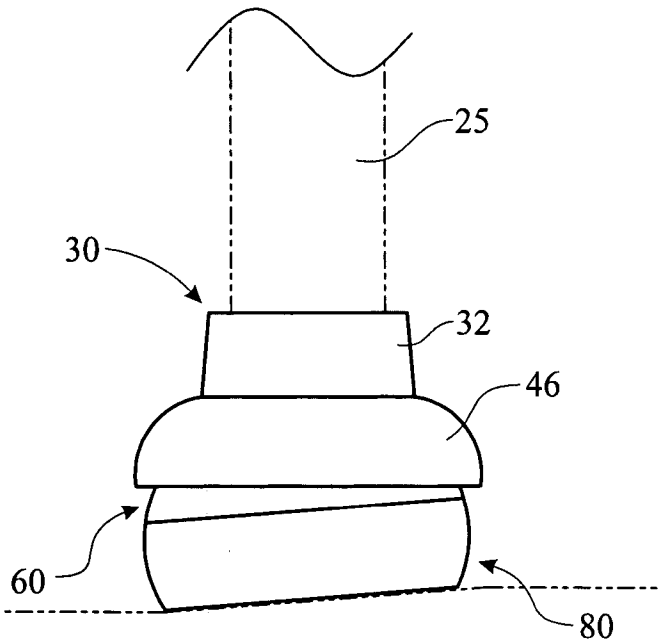
FIG. 6 is an side elevation view of a walker leg wherein the surface on which it rests is uneven illustrating the articulation of the glide assembly.

Referring now to FIGS. 5-7, the articulation capability of foot 60 with respect to leg 25 is illustrated. As shown in FIG. 5 by arrows "X-X" and "Y-Y" the engagement of spherical surface 64 of foot 60 in spherical chamfer 54 in insert 50 permits foot 60 and attached glide 80 to pivot in any direction. The pivoting is illustrated further in FIGS. 6-7. Cannular sleeve 34 and leg 25 share a common central axis "A" and pin 66 has a central axis "C". When leg 25 is at right angles to the surface 18 on which it rests, axies "A" and "C" are coincident. However, when leg 25 is angulated with respect to surface 18, glide 80 remains in complete contact with surface 80 while insert 50 pivots over spherical surface 64 of foot 60. The clearance between the sides of hole 52 in insert 50 and pin 66 of foot 60 permit approximately twenty degrees of articulation (represented by angle "C") between foot 60 and leg 25 thereby maximizing the traction area of glide 80 with respect to surface 18 and reducing the wear on glide 80.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

I claim:

1. An articulating glide assembly for use on a walker that assists disabled individuals to walk, said articulating glide assembly comprising:

an adapter having a resilient cannular sleeve defining an opening at a top end thereof for engaging a leg of a walker and an aperture at a bottom end;

a rigid base insert engaged in said aperture at said bottom end of said sleeve for supporting the downward force exerted by the walker, said base insert defining a hole therethrough;

an articulating foot includes an upwardly extending spherical surface from a top of said foot and a pin extending upwardly from said spherical surface, said spherical surface engaging an edge of said hole in said base insert and said pin extending through said hole and movably engaged therein; and a glide removably affixed to a lower portion of said articulating foot.

2. The articulating glide assembly according to claim 1 further including a retainer ring engaged on an upper portion of said pin, said retainer ring having an outside diameter larger than said hole in said base insert.

3. The articulating glide assembly according to claim 1 wherein said edge of said hole in said base insert is spherically chamfered for engagement with said spherical surface on said foot.

4. The articulating glide assembly according to claim 3 in which said hole in said base insert is larger than said pin to allow said spherical surface of said articulating foot to angularly articulate in said spherical chamfer.

5. The articulating glide assembly according to claim 4 in which said hole in said base insert is sufficiently large to permit said foot to articulate at least twenty degrees with respect to a longitudinal axis of said adapter sleeve.

6. The articulating glide assembly according to claim 1 wherein said articulating foot defines a peripheral lip groove about an outer surface thereof and wherein said glide comprises a resilient tread layer having an upwardly extending wall therefrom for receiving said lower portion of said foot therein and a lip extending inwardly from a top edge of said wall said lip engaged in said lip groove to affix said glide to said foot.

7. The articulating glide assembly according to claim 6 wherein said glide includes a wear indicator.

8. The articulating glide assembly according to claim 7 wherein said wear indicator is a concavity in a bottom surface of said resilient tread layer.

* * * * *